United States Patent [19]

Fujii

[11] Patent Number: 4,855,788

[45] Date of Patent: Aug. 8, 1989

[54] COPIER WITH IMPROVED PAPER TRANSPORTING MEANS

[75] Inventor: Yoshihalu Fujii, Nara, Japan

[73] Assignee: Sharp Kabushiki Kaisha, Osaka, Japan

[21] Appl. No.: 240,417

[22] Filed: Sep. 1, 1988

Related U.S. Application Data

[63] Continuation of Ser. No. 38,781, Apr. 15, 1987, abandoned.

[30] Foreign Application Priority Data

Apr. 15, 1986 [JP] Japan ..... 61-87452
Jun. 17, 1986 [JP] Japan ..... 61-142133
Jun. 27, 1986 [JP] Japan ..... 61-151975

[51] Int. Cl.[4] ..... G03G 15/00; B65H 3/44

[52] U.S. Cl. ..... 355/313; 355/3 SH; 355/23; 355/321; 271/9

[58] Field of Search ..... 355/3 SH, 14 SH, 23; 271/3.1, 9, 291

[56] References Cited

U.S. PATENT DOCUMENTS 4,099,150 7/1978 Connin ..... 271/3.1 X
4,140,387 2/1979 Gustafson ..... 355/14 SH
4,248,525 2/1981 Sterrett ..... 271/3.1 X
4,297,025 10/1981 Bach et al. ..... 355/3 SH X
4,451,137 5/1984 Farley ..... 355/14 SH X
4,705,393 11/1987 Ito ..... 355/14 SH

*Primary Examiner*—A. T. Grimley
*Assistant Examiner*—Ed Pipala
*Attorney, Agent, or Firm*—Flehr, Hohbach, Test, Albritton & Herbert

[57] ABSTRACT

A copier is equipped with an automatic paper transporting device such that documents which have been processed and removed from a document processing position can be discharged onto a receiving discharge tray in a specified sequence. The discharge sequence is stored as input data and a central processing unit makes reference to these data in controlling the motion of the documents, determining for each document whether it should go directly onto the discharge tray or should be temporarily held on another tray. Similar transporting devices can be used in connection with a copier such that documents can be fed in a specified order which may be different from the way they are stacked or that copy paper sheets processed in a certain sequence may be discharged in a different specified sequence.

3 Claims, 15 Drawing Sheets

| STEP | 0 | 1 | 2 | 3 | 4 | 5 | 6 | 7 | 8 | 9 | 10 | 11 | 12 | 13 |
|---|---|---|---|---|---|---|---|---|---|---|---|---|---|---|
| TRAY A | | | | | | 5 | 5 | 5 | 4<br>5 | 3<br>4<br>5 | 3<br>4<br>5 | 2<br>3<br>4<br>5 | 2<br>3<br>4<br>5 | 1<br>2<br>3<br>4<br>5 |
| TRAY B | | 1 | 2<br>1 | 4<br>2<br>1 | 3<br>4<br>2<br>1 | 3<br>4<br>2<br>1 | 4<br>2<br>1 | 2<br>1 | 2<br>1 | 2<br>1 | 1 | 1 | | |
| TRAY C | | | | | | | 3 | 4<br>3 | 3 | | 2 | | 1 | |
| SUPPLY TABLE | 1<br>2<br>4<br>3<br>5 | 2<br>4<br>3<br>5 | 4<br>3<br>5 | 3<br>5 | 5 | | | | | | | | | |
| MODE | — | 1 | 1 | 1 | 1 | 2 | 3 | 3 | 5 | 5 | 3 | 5 | 3 | 5 |

| STEP | TRAY A | TRAY B | TABLE | MODE |
|---|---|---|---|---|
| 0 | 1 2 3 4 5 | | | |
| 1 | 1 2 3 4 | 5 | | 1,2 |
| 2 | 1 2 3 | 4 5 | | 1,2 |
| 3 | 1 2 | 4 5 | 3 | 1 |
| 4 | 1 2 | 3 4 5 | | 2 |
| 5 | 1 | 2 3 4 5 | | 1,2 |
| 6 | | 1 2 3 4 5 | | 1,2 |
| 7 | | 1 2 3 4 | 5 | 3 |
| 8 | 5 | 1 2 3 4 | | 4 |
| 9 | 4 5 | 1 2 3 | | 3,4 |
| 10 | 3 4 5 | 1 2 | | 3,4 |
| 11 | 3 4 5 | 1 | 2 | 3 |
| 12 | 2 3 4 5 | 1 | | 4 |
| 13 | 1 2 3 4 5 | | | 3,4 |
| 14 | 1 2 3 4 | 5 | | 1,2 |
| 15 | 1 2 3 | 5 | 4 | 1 |
| 16 | 1 2 3 | 4 5 | | 1,2 |
| 17 | 1 2 | 3 4 5 | | 1,2 |
| 18 | 1 | 2 3 4 5 | | 1,2 |
| 19 | | 1 2 3 4 5 | | 1,2 |
| 20 | 5 | 1 2 3 4 | | 3,4 |
| 21 | 4 5 | 1 2 3 | | 3,4 |
| 22 | 3 4 5 | 1 2 | | 3,4 |
| 23 | 2 3 4 5 | 1 | | 3,4 |
| 24 | 1 2 3 4 5 | | | 3,4 |

FIG. — 14

COPIER WITH IMPROVED PAPER TRANSPORTING MEANS

This is a continuation of application Ser. No. 038,781 filed Apr. 15, 1987, now abandoned.

BACKGROUND OF THE INVENTION

This invention relates generally to an image forming apparatus such as a copier with improved means for feeding OR removing original documents to be copied or discharging copy paper sheets which have been processed. In one aspect, the present invention relates more particularly to a copier capable of discharging copied original documents in a specified sequence. In another aspect, the present invention relates to an automatic document feeder capable of feeding a plurality of documents to a copier or the like such that they can be exposed to a copy lamp in a specified sequence. In still another aspect, the present invention relates to a copier capable of changing the sequence in which the processed sheets of copy paper are discharged.

With a conventional image forming apparatus such as a copier equipped with an automatic document feeder, documents to be copied are transported from a document supplying section such as a document tray to the exposure position on the document table in the order in which they are copied, and the documents removed from the document table are accordingly discharged onto a document discharge tray or the like in the same order in which they are copied. When a plurality of documents which form a set are copied, however, it is not always desirable or even convenient to copy them in the order of their page numbers. For improving the efficiency of the copying work, documents of the same size may be processed together independently of their page numbers. Likewise, documents to be enlarged with the same magnification may be lumped together and processed successively. In such a situation, discharged documents after they have been copied must be rearranged usually by hand into the original sequence. Not only is this a cumbersome job but documents are easily misarranged during such a manual operation.

With a conventional copier of the type considered above, processed sheets of copy paper are discharged either in the same order in which documents were copied or in the reverse order. If it is desired to obtain copies in an order different from the order in which the original documents are stacked, therefore, the order of discharged copy paper sheets must be changed or the order of the documents must be preliminarily changed. Either method is troublesome to execute.

SUMMARY OF THE INVENTION

It is therefore an object of the present invention to provide a document transporting device capable of discharging processed documents from an image forming apparatus such as a copier onto a discharge tray in a specified sequence.

It is another object of the present invention to provide a document transporting device capable of transporting stacked documents on a tray in a specified sequence to a copier for exposure to light.

It is still another object of the present invention to provide a copier capable of discharging processed copy paper in a specified sequence which may be different from the sequence in which they are processed.

A copier according to one embodiment of the present invention is characterized as having intermediate trays between document discharging means and a document discharge tray. If it is desired to place sequentially discharged documents in the discharge tray in a specified different sequence, sequence data representing a desired sequence are stored in a memory means and the documents are transported from the discharging means either directly to the discharge tray or temporarily to one of the intermediate trays according to the stored sequence data. Some of the documents are further transported through the other of the intermediate trays such that documents can be arranged in the desired sequence in the discharge tray.

In another aspect, the present invention relates to an automatic document feeder having a supply tray on which documents are stacked, a transporting device for transporting one document at a time from this tray to a processing position where, for example, the document may be exposed to light for copying and also from there back to the supply tray or to an intermediate tray where documents can be temporarily stored for sorting. If a user selects a sequence in which the stacked documents are to be processed at the processing position, a control unit establishes an operating program according to which the feeder operates to make use of the trays strategically not only to process the documents in the specified sequence but also to return all the documents back onto the supply tray in the way they were originally stacked.

A copier according to still another embodiment of the present invention is capable of discharging copy paper sheets in a specified sequence which may be different from the order of actually making copies. The desired sequence is stored in a memory device as a series of numbers. If copies are to be made in the order of page numbers 1, 2, 3 . . . but the desired discharge sequence is 3, 5, 4, . . . for example, the desired sequence may be stored in the form of M(1)=3, M(2)=5, M(3)=4, . . . In addition to a paper processing section where image is transferred onto a copy paper sheet and a paper discharge section, a copier of the present invention is provided with a holding section which is connected to a transporting route between the paper processing section and the discharging section such that a processed copy paper sheet from the processing section can be transported either directly to the discharge section or to the holding section to be temporarily stored therein. This choice is made by comparing the number of sheets already discharged into the discharge section and the sequence number such as 3, 5, 4, . . . in the example given above. If one sheet is already in the discharge section and the second sheet to be discharged is wanted, for example, the incoming copy paper from the processing section will be diverted to the holding section unless it is the fifth (because M(2)=5) copy paper sheet. After each time a copy paper sheet is deposited in the discharge section, if the next sheet to be discharged according to the desired sequence is already in the holding section, a mechanism inside the holding section functions in such a way that the correct one is picked out and transported to the discharge section. Data indicative of the order in which the copy paper sheets temporarily stored in the holding section are stacked are also stored in a memory device and the copier controls the motion of the copy paper sheets such that they are discharged in the desired sequence.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 14 is a drawing showing a sequence of motion of documents.

DETAILED DESCRIPTION OF THE INVENTION

Figure 1:
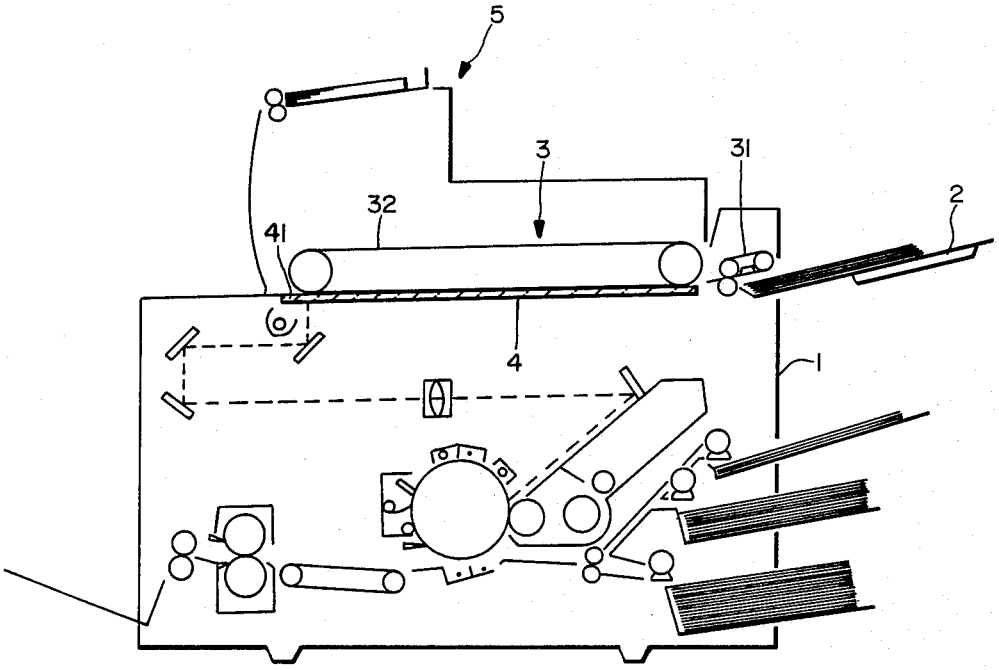
FIG. 1 is a schematic sectional view of a copier equipped with a document transporting device embodying the present invention.
Figure 2:
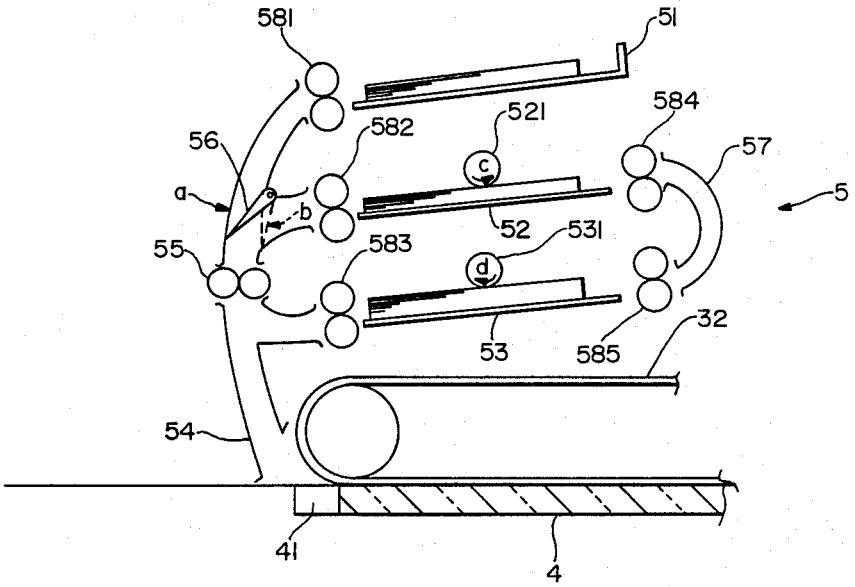
FIG. 2 is a schematic sectional view of the document transporting device shown in FIG. 1.

With reference to FIG. 1 which schematically shows the structure of a copier equipped with a document transporting device embodying the present invention, an automatic document feeder (ADF) 3 for feeding documents stacked on a document supply table 2 one sheet at a time is disposed at an elevated part of a housing 1. The automatic document feeder 3 includes document feeding rollers 31 and a document transporting belt 32. A front edge sensor 41 for detecting the front edge of a document introduced onto a document table 4 is disposed at a front part of the table 4. A document transporting device 5 embodying the present invention is disposed above the belt 32 which serves to transport a document from the top of the document table 4 to the document transporting device 5. With reference to FIG. 2 which schematically shows the structure of the document transporting device 5, there is a document discharge tray 51 above the document transporting belt 32, and there are also a first intermediate tray 52 and a second intermediate tray 53 between the belt 32 and the document discharge tray 51, disposed in parallel relationship with the document discharge tray 51. A document guide 54 for guiding a document from the belt 32 is provided so as to connect the belt 32 with the left-hand ends of the document discharge tray 51, the first intermediate tray 52 and the second intermediate tray 53. Guide rollers 55 and a flapper 56 are provided inside the guide 54. The flapper 56 is adapted to take one of two positions indicated by "a" and "b" according to the document being transported. The other ends (on the right-hand side) of the first intermediate tray 52 and the second intermediate tray 53 are connected by another guide 57 such that a document transmitted from the first intermediate tray 52 can be discharged onto the second intermediate tray 53. Document transporting rollers 581, 582, 583, 584 and 585 are provided as shown at the ends of the trays 51, 52 and 53 through which a document is introduced into or removed from these trays 51, 52 and 53. Pickup rollers 521 and 531 are disposed respectively above the first intermediate tray 52 and above the second intermediate tray 53, serving to remove a document therebelow. These pickup rollers 521 and 531 are pressed against the top one of the documents stacked therebelow by means of biasing springs (not shown). There rotary motions in the directions of the arrows c and d are controlled by signals from a control unit (not shown).

The operation of the document transporting device 5 is explained next. A document on the supply table 2 is moved first onto the document table 4 by the motion of the document feeding rollers 31, and then along the top surface of the document table 4 by the motion of the document transporting belt 32. When the front edge of this document reaches the position of the front edge sensor 41, the front edge of the document is detected by the sensor 41 and this causes the rotational motion of the belt 32 to stop. After the document on the document table 4 is copied, the document transporting belt 32 starts to rotate again and the document is transported away from the document table 4 along the guide 54.

Figure 3:
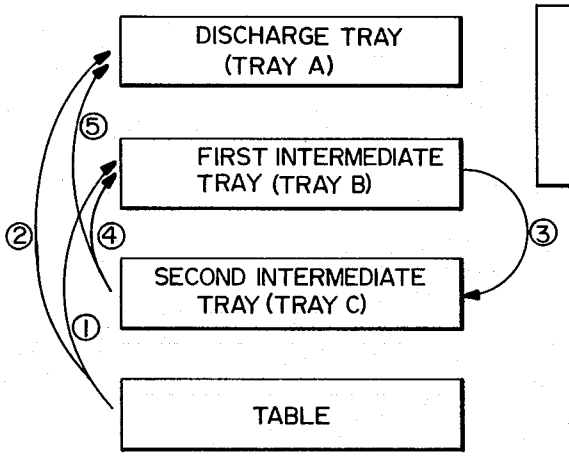
FIG. 3 is a drawing for explaining the modes of operation of the document transporting device of FIG. 2.

If the flapper 56 is in position "a" at this moment, the document being removed from the top of the document table 4 is transported in the direction of the first intermediate tray 52 and is discharged thereonto by the motions of the guide rollers 55 and the transporting rollers 582 (Mode 1). If the flapper 56 is in position "b" instead, the document is transported in the direction of the document discharge tray 51 and is discharged thereonto by the motions of the guide rollers 55 and the transporting rollers 581 (Mode 2). The document on the first intermediate tray 52 or at the top of a stack thereon can be transported in the direction of the second guide 57 by the rotation of the pickup roller 521 in the direction of arrow c, passed through the guide 57 by the motions of the transporting rollers 584 and discharged into the second intermediate tray 53 by the motions of the transporting rollers 585 (Mode 3). The document on the second intermediate tray 53 or at the top of a stack thereon can be removed by the rotation of the pickup roller 531 in the direction of arrow d and transported into the guide 54 by the motions of the transporting rollers 583. If the flapper 56 is in position "a" at this moment, this document is transported in the direction of the first intermediate tray 52 and discharged thereonto by the motions of the guide rollers 55 and the transporting rollers 582 (Mode 4). If the flapper 56 is in position "b" in the above situation, the document is transported in the direction of discharge tray 51 and is discharged thereonto by the motions of the guide rollers 55 and the transporting rollers 581 (Mode 5). These modes of operation are illustrated in FIG. 3, each mode being indicated by the corresponding numeral. For the sake of simplicity, the document discharge tray 51, the first intermediate tray 52 and the second intermediate tray 53 of FIG. 2 are hereinafter also referred to as Tray A, Tray B and Tray C, respectively, as illustrated in FIG. 3.

With modes of operation thus made available, documents which have been copied and removed from the document table 4 in the sequence of 1, 2, 3, . . . can be discharged onto the discharge tray 51 in a modified sequence such as 2 3, 1, . . . . For this example, the first document is discharged onto the first intermediate tray 52 by the first mode of operation, the second document is discharged onto the discharge tray 51 by the second mode of operation, and the third document is discharged again onto the discharge tray 51 by the second mode of operation. At this moment, the document to be discharged next onto the discharge tray 51 is the first one which is on the first intermediate tray 52. Thus, this document is thereafter discharged onto the second intermediate tray 53 by the third mode of operation and then onto the discharge tray 51 by the fifth mode of operation. In summary, documents being sequentially removed from the document table 4 can be discharged onto the discharge tray 51 in a modified sequence by controlling the position of the flapper 56 and the rotations of the pickup rollers 521 and 531.

Figure 4:
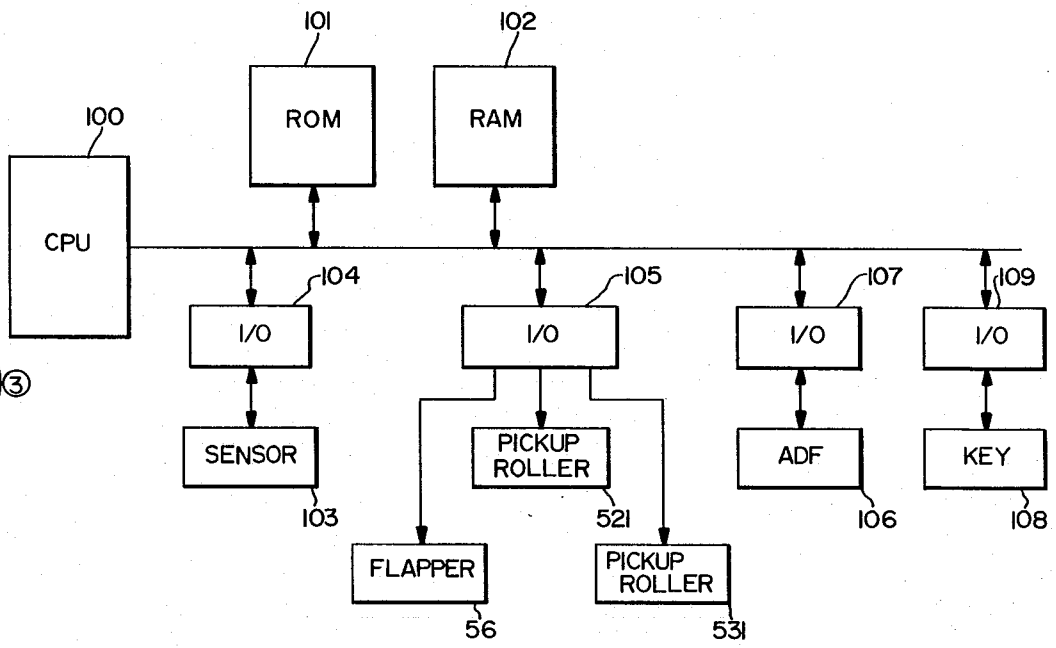
FIG. 4 is a block diagram of the control unit of a copier incorporating the document transporting device of FIG. 3, FIGS. 5 and 6 are flow charts of the operation of the control unit.

With reference to FIG. 4, the overall control of the copier of FIG. 1 incorporating the document transporting device 5 embodying the present invention is effected by a CPU 100 according to a program stored in ROM 101. RAM 102 is used as working area for flags, counters, etc. in the execution of this program. Numeral 103 indicates a plurality of sensors inclusive of the aforementioned front edge sensor 41. The CPU 100 is adapted to read output signals from each sensor through an I/O means 104. The flapper 56 and the pickup rollers 521 and 531 are connected to another I/O means 105 and operate according to signals from the CPU 100. The automatic document feeder ADF 106 controls the motion of the document transporting belt 32 and exchanges data with the CPU 100 through another I/O means 107. KEY 108 indicates a key input device from which the CPU 100 is adapted to receive input signals through still another I/O means 109.

Figure 5:
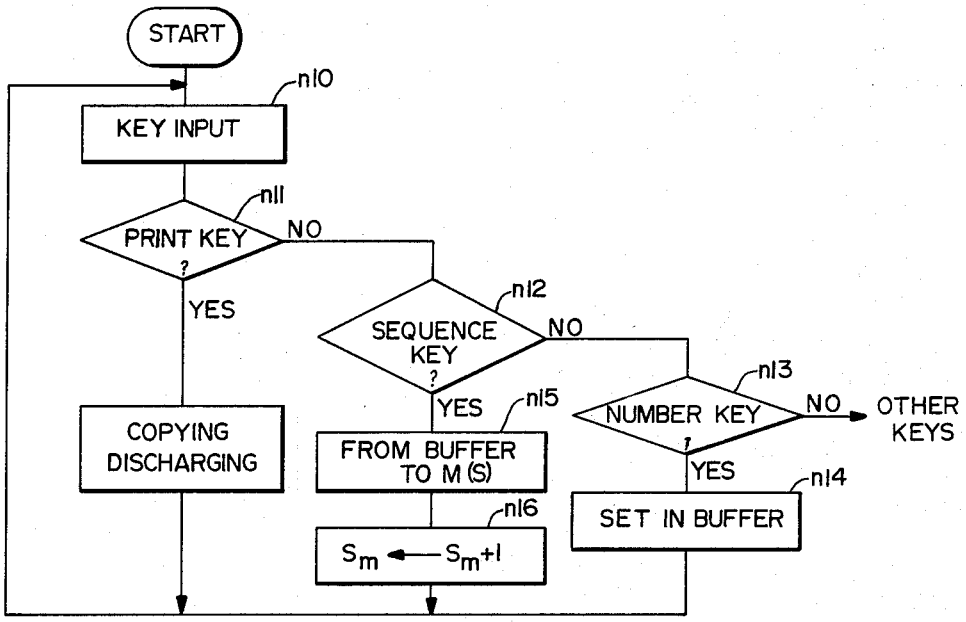
Figure 7:
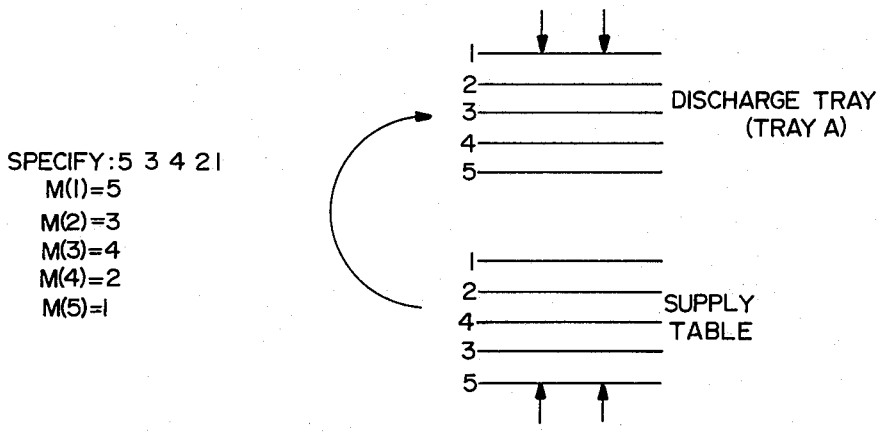
FIGS. 7 and 8 are drawings for showing an example of the process embodying the present invention for transporting documents by specifying their sequence.
Figure 6A:
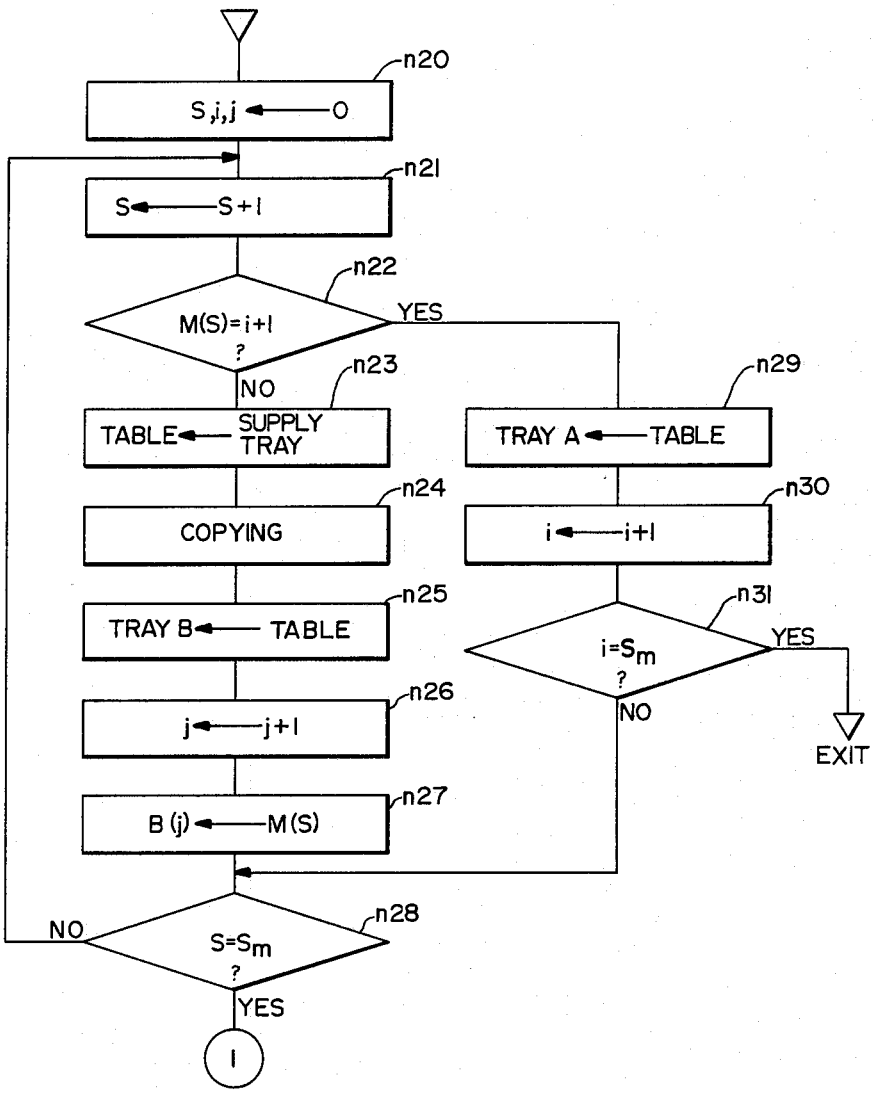
Figure 6B:
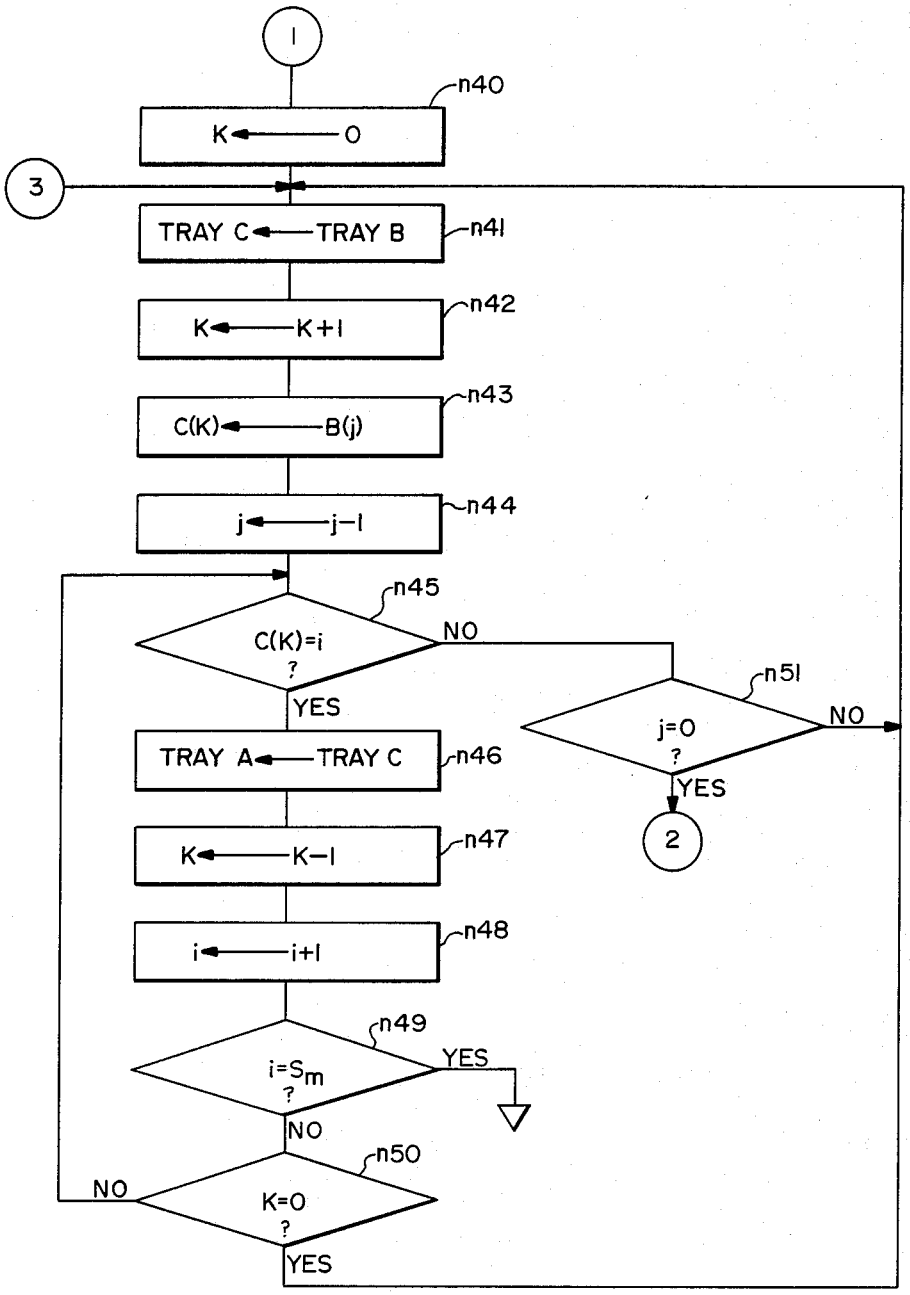
Figure 6C:
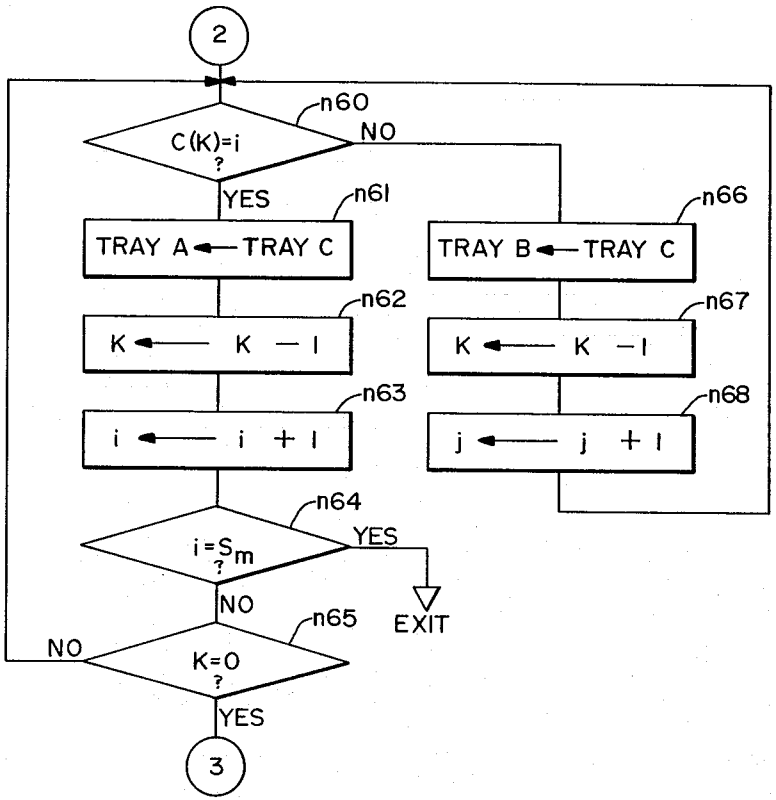

Operation of the aforementioned control unit is explained next by way of the flow charts in FIGS. 5 and 6. With reference first to FIG. 5, input data are received initially (n10) so that the copier is operated according to these input data. If a number key is operated (n13), the corresponding number is set in a buffer (n14). If a sequence key is operated thereafter (n12), the content of the aforementioned buffer is put in memory area M(S) (n15) and dummy variable $S_m$ counting the number of documents is increased by 1 (n16). By thus operating the number and sequence keys alternately, the user stores in memory areas M(S) a set of data indicating the order of discharging documents. If sequence 5, 4, 3, 2, 1 is set as the desired sequence of discharging documents, as shown in FIG. 7 as an example, these values become stored in the memory areas M as the discharge sequence. The memory areas M are also referred to below as the discharge sequence memory areas.

If the print key is operated (n11) thereafter, copying and discharging processes are carried out according to the flow chart of FIG. 6, which shows the operation sequence of what will be referred to below as the selective document transporting means. In FIG. 6, M(S) indicates values stored in memory areas described by the same symbol, and i, j, and k are variables respectively indicating the number of documents which have been discharged onto the discharge tray (Tray A), that on the first intermediate tray (Tray B) and that on the second intermediate tray (Tray C). B(j) and C(k) indicate memory areas for storing identifications of documents on the first and second intermediate trays, respectively.

At the beginning of the copying-discharging process, variables S, i and j are initialized (reset) (n20). The value of S is increased by 1 (n21) and compared with i+1 (n22). If they are equal, the document being removed from the document table 4 can be directly discharged onto Tray A. Thus, the operation in Mode 2 is effected (n29) and after i is increased by 1 (n30), it is checked if its value has reached the total number of documents $S_m$ (n31). If M(S) is not equal to i+1 in Step n22, the next document on the document supply table 2 is transported onto the document table 4 (n23), copied (n24) and tentatively discharged onto Tray B (n25). Thereafter, the variable j is increased by 1 (n26) and the sequence information M(S) for this document is stored in B(j) (n27). This is repeated until all documents are copied (n28).

After all documents have been copied (YES in n28), another variable k is initialized (n40), the top document of the stack then on Tray B is transported onto Tray C by an operation in Mode 3 (n41), the content of B(j) is transferred to C(k) (n43) and j is reduced by 1 (n44). After this is done, it is examined whether the document thus transported onto Tray C is the ith document or not (n45). If so, this document is discharged onto Tray A by an operation in Mode 5 (n46), k is reduced by 1 (n47) and i is increased by 1 (n48). Thereafter, it is checked whether the document which appears next at the top of the stack on Tray C is the one to be discharged next (n49-n50-n45). If k=0, indicating that there is no more document on Tray C (YES in n50), the program goes back to Step n41 and the next document is transported from Tray B onto Tray C. If the document now at the top of the stack on Tray C is not the one to be discharged next (NO in n45), similar processes are repeated (n45-n51-n41) until there is no document left on Tray B. If all documents tentatively on Tray B have been transported to Tray C (YES in n51), it is checked whether the document at the top of the stack on Tray C is the one to be discharged or not (n60). If it is, this document is discharged onto Tray A (n61) by an operation in Mode 5, k is reduced by 1 (n62) and i is increased by 1 (n63). If it is not, this document is returned onto Tray B by an operation in Mode 4 (n66), k is reduced by 1 (n67) and j is increased by 1 (n68). This is repeated until all documents on Tray C are gone (n65). If the number of documents which have been discharged onto Tray A has not reached the total number of documents to be copied $S_m$ although there is no document any more on Tray C, this means that some documents are still left on Tray B and Steps n65–n41 are repeated. Thus, all documents are discharged onto Tray A in the specified sequence (n49-EXIT and n64-EXIT).

Figures 8, 9:
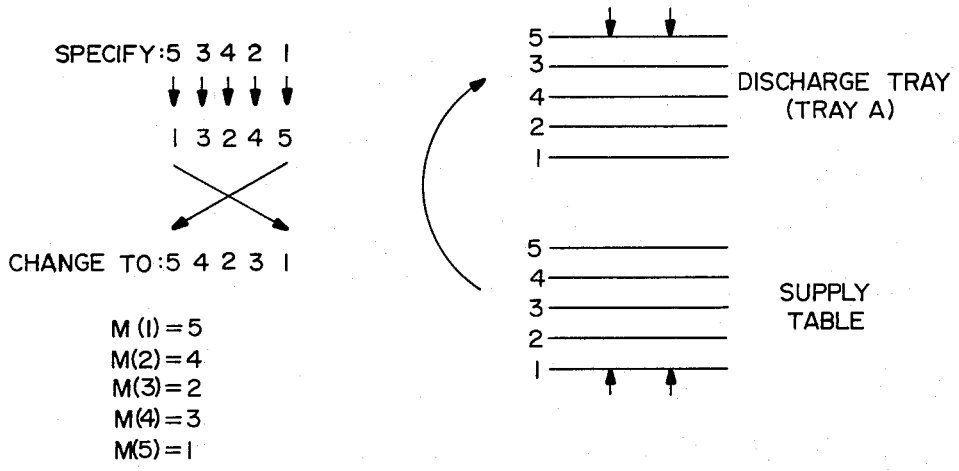
FIG. 9 is a drawing for showing another example of process according to another embodiment of the present invention for transporting documents by changing their sequence.

As an example of the process described above, let us consider a situation where five documents are stacked with the faces down on the document supply table 2 in the order of pages 5, 3, 4, 2, 1 from the bottom. If the discharge sequence is set similarly as 5, 3, 4, 2, 1, these documents, after being copied, are discharged onto the document discharge tray with the faces up in the order of pages 1, 2, 3, 4, 5 from the top as shown in FIG. 7 where the arrows show the front surfaces. Stepwise movements of each document in this example are shown in FIG. 8. In the first four steps, pages 1, 2, 4 and 3 are sequentially transported onto Tray B by an operation in Mode 1 and tentatively kept thereon, stacked in the order in which they are copied. In the fifth step, page 5 is directly discharged onto Tray A by an operation in Mode 2. Thereafter, operations in Modes 3 and 5 are repeated, causing the documents on Trays B and C to be sequentially discharged onto Tray A.

Alternatively, the user may specify a desired discharge sequence with reference to the sequence in which the documents are stacked on the supply table. For example, let us assume that five documents are stacked sequentially in the order of pages 1, 2, 3, 4, 5 as shown in FIG. 9 and it is desired to have them discharged in the order of 5, 3, 4, 2, 1. In this case, each number representing the sequence is subtracted from the total number of documents (5 in this example) and 1 is added to the difference to obtain a new series of numbers. In this example, the new series thus obtained will be 1 (=5−5+1), 3 (=5−3+1), 2 (=5−4+1), 4 (=5−2+1), 5 (=5−1+1). In the next step, the order is reversed, and one obtains for this example 5, 4, 2, 3, 1, and this series of numbers is set in memory areas M(S) as the sequence data when the program described above is used.

Figure 10:
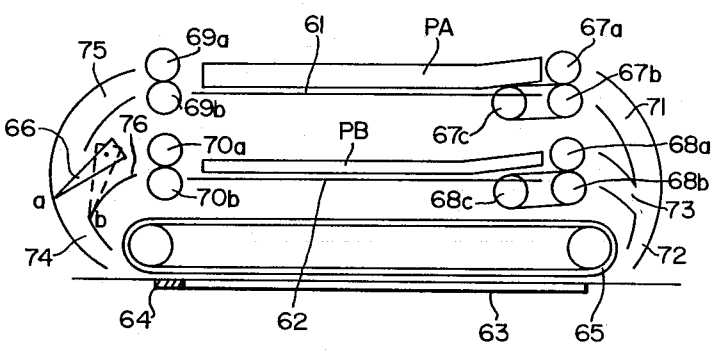
FIG. 10 is a schematic sectional view of a document transporting device according to another embodiment of the present invention for transporting documents to a copier in a specified sequence.

Another paper transporting device embodying the present invention which is adapted for feeding documents in a specified sequence is illustrated in FIG. 10 wherein numeral 61 indicates a document supply tray on which are stacked documents to be transported onto a document table 63 to be copied. The document supply tray 1 is disposed above a document transporting belt 65 and an intermediate tray 62 is disposed between the document supply tray 61 and the belt 65 in parallel relationship with the document supply tray 61. Document passageways 71, 72, 73, 74, 75 and 76 connecting the document supply tray 61, the intermediate tray 62 and the document table 63 are provided as shown such that a document sent out from the document supply tray 61 is transported to the document table 63 by the passageways 71 and 72, and a document sent from the document table 63 can be discharged onto the document supply tray 61 by passing through the passageways 74 and 75. The passageway 76 is for transporting a document sent from the document table 63 to the intermediate tray 62. A flapper 66 is provided at the end of the passageway 74 away from the document table 63 such that if it is at position "a", the document passes through the passageways 74 and 76 to be discharged onto the intermediate tray 62. If the flapper 66 is at position "b" instead, the document sent from the document table 63 through the passageway 74 is directed towards the document supply tray 61. A document pushed out of the intermediate tray 62 passes through the passageway 73 to the document table 63.

Feeder rollers **67*a*, 67*b* and 67*c* disposed at the right-hand edge of the document supply tray 61 serve to pull out the bottom one of documents PA stacked on the document supply tray 61 to transport it in the direction of the passageway 71. Similarly, feeder rollers 68*a*, 68*b* and 68*c* disposed at the right-hand edge of the intermediate tray 62 serve to pull out the bottom one of documents PB stacked on the intermediate tray 62 to transport it in the direction of the passageway 73. Discharging rollers 69*a* and 69*b* at the left-hand edge of the document supply tray 61 serve to place a document which is transported from the passageway 75 on top of the documents PA already stacked on the document supply tray 61. Similarly, discharging rollers 70*a* and 70*b* at the left-hand edge of the intermediate tray 62 serve to place a document which is transported through the passageway 76 on top of the documents PB already stacked on the intermediate tray 62**.

Figure 11:
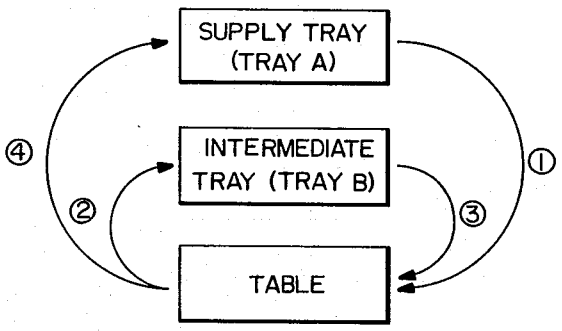
FIG. 11 is a drawing for explaining the modes of operation of the device of FIG. 10, FIGS. 12 and 13 are flow charts of the operation of a copier with document transporting device of FIG. 10.

A front edge sensor 64 is set near the left-hand edge of the document table 63. The motion of the document transporting belt 65 is stopped when the front edge of a document which is transported along the top surface of the document table 63 reaches the position of this sensor 64 such that the document is temporarily held stationary at a predetermined position on the document table 63 to be exposed by an exposure means (not shown) disposed below the document table 63. As done above in connection with the explanation of a copier described by way of FIGS. 1–9, the document supply tray 61 and the intermediate tray 62 of FIG. 10 are hereinafter referred to also as Tray A and Tray B, respectively. Similarly, Modes 1, 2, 3 and 4 of operation are respectively defined as transportation of a document from Tray A to the document table 63, from the document table 63 to Tray B, from Tray B to the document table 63 and from the document table 63 to Tray A, as illustrated in FIG. 11. By selective operations of the document transporting device of FIG. 10 in these four modes, documents can be fed to the document table 63 in any desired sequence.

Figure 12:
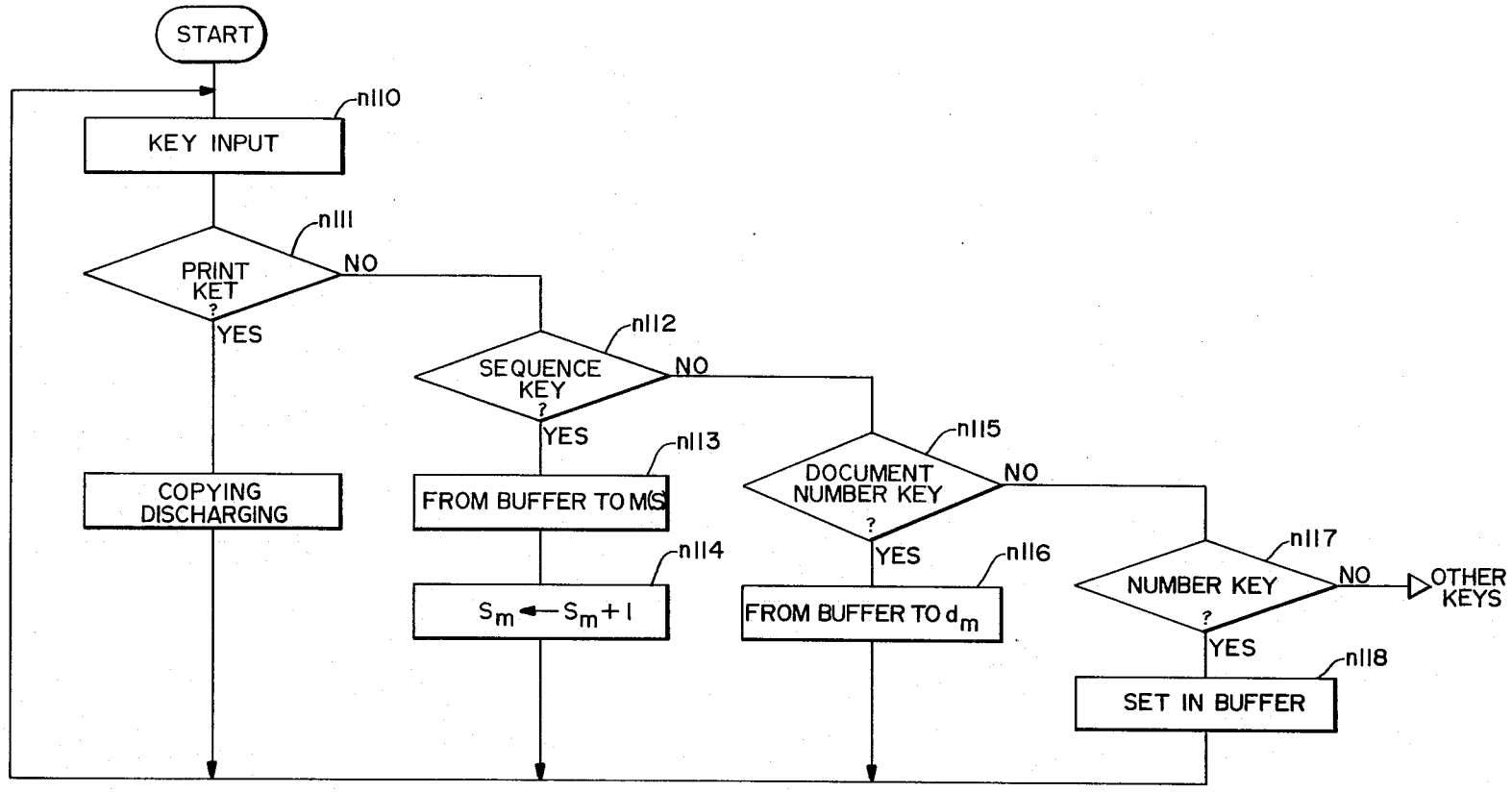

A control unit for controlling the overall operation of a copier incorporating the document transporting device of FIG. 10 can be described by the block diagram shown in FIG. 4 and hence will not be explained separately. In what follows, operation of such a control unit as applied to the document transporting device of FIG. 10 is explained by way of flow charts of FIGS. 12 and 13. With reference first to FIG. 12, input data are received initially, say, from a keyboard n(110) so that the copier is operated according to the keys that are operated. If a number key or keys are operated (n117), the corresponding number is set in a buffer (n118). If a sequence key is operated thereafter n(112), the aforementioned number set in the buffer is put in memory areas M(S) (n113) and dummy variable sm counting the number of documents to be copied is increased by 1 n(114). Thus, as explained above in connection with FIG. 5, data indicative of a desired sequence in which documents are to be copied become stored in memory areas M(S) by alternately operating the number and sequence keys. If a document number key is operated (n115) after a number is set in the buffer (n118), the number stored in the buffer is set in memory area $d_m$ (n116).

Figure 13A:
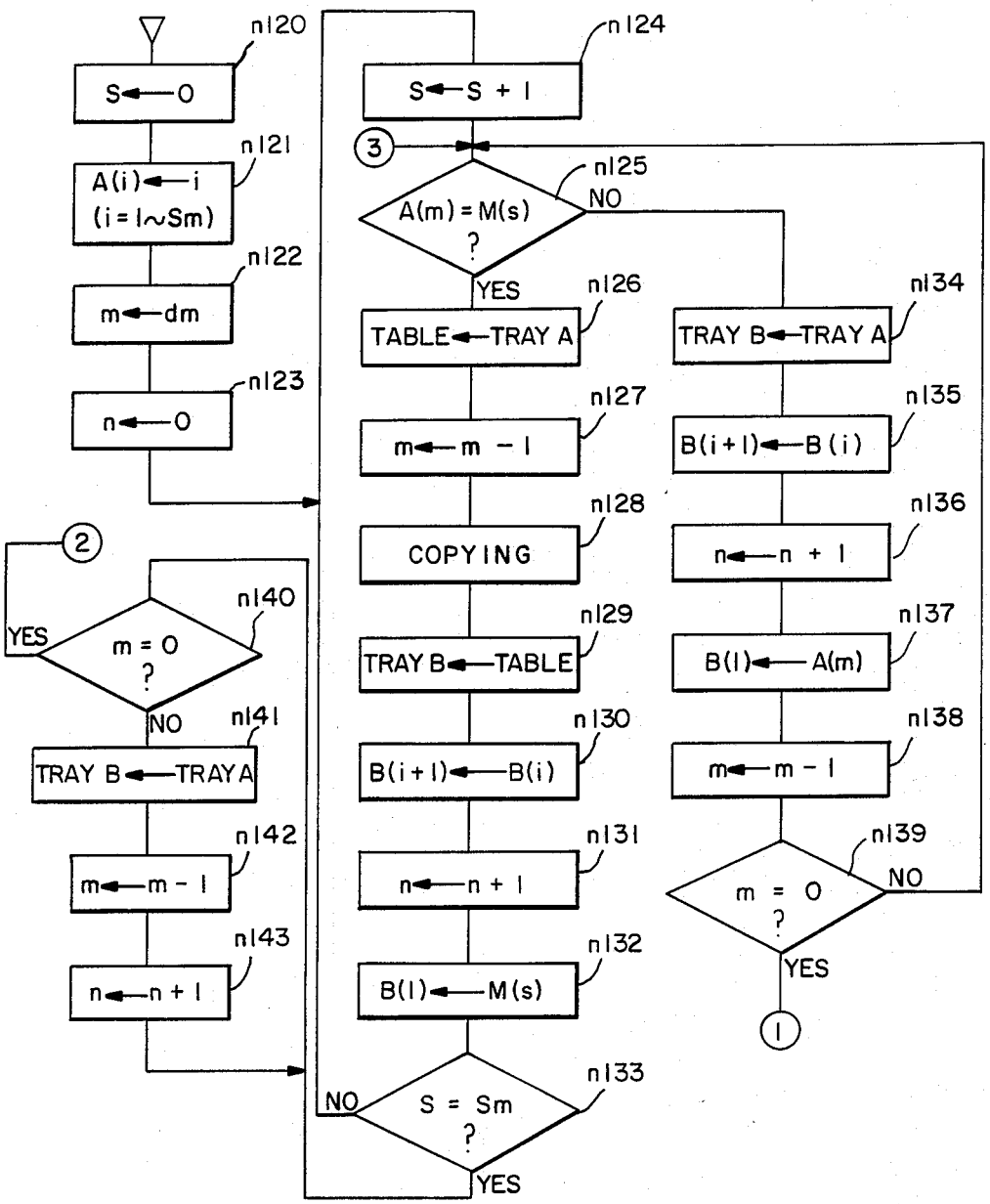
Figure 13B:
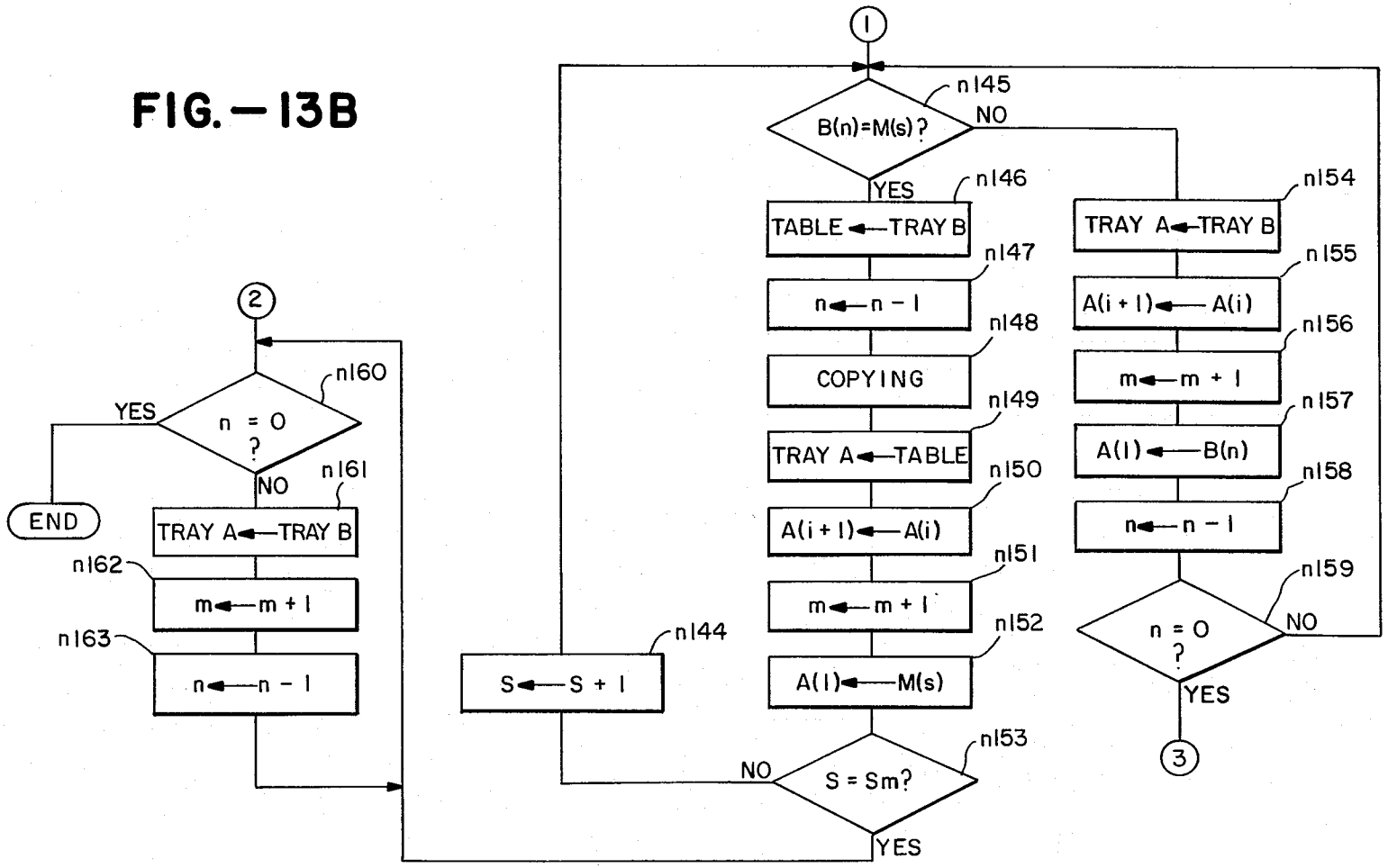

If the print key is operated thereafter (n111), copying and discharging processes are carried out according to the flow chart of FIG. 13 where A(i) and B(i) respectively represent memory areas storing sequence information of documents on Tray A and Tray B, m and n are respectively numbers of documents currently stored on Tray A and Tray B and also represent memory areas storing these numbers. With reference to FIG. 13, S, A(i), m and n are initialized first, that is, dummy variable S is set to 0 (n120), A(i) are set according to the desired sequence in which $S_m$ documents in total are to be copied (n121), the number of documents $d_m$ on Tray A is set in the memory area m (n122) and since there is no document to start with on the intermediate tray 62, n is set to 0 (n123). After the initialization process, S is increased by 1 (n124) and if M(S) is equal to A(m) (YES in n125), this means that the bottom document on Tray A which, therefore, is the next to be sent out therefrom is indeed the one desired to be copied next. Thus, this document is transferred from Tray A onto the document table 63 by an operation in Mode 1 (n126). The number of documents on Tray A thereby decreases by 1 and hence the value of m (stored in the memory area m) is reduced by 1 (n127) and the document transported onto the document table 63 is copied (n128) and thereafter transported from the document table 63 onto Tray B by an operation in Mode 2 (n129). In order to describe the consequence of this transfer, the content of memory areas B(i) are shifted to B(i+1) where i=1 to n (n130), n is increased by 1 (n131) and M(S) is newly stored in the memory area B(1) (n132). This process is repeated until the desired number $S_m$ of copies are made (n133).

In Step n125, if the bottom document on Tray A is not the one to be copied next, this document is transported onto Tray B for temporary storage by a combination of operations in Modes 1 and 2 (n134). As explained above regarding Steps n127 through n132, this transfer necessitates similar shifting of the contents of memory areas B(i) (n135), that is, addition of 1 to n (n136), storage of the content of A(m) in B(1) (n137) and reduction of m by 1 (n138). Unless Tray A has still more documents thereon (YES in n139), the program proceeds to transport documents on Tray B in the desired order onto Tray A. First, if the bottom document on Tray B which is therefore the next one to be removed from Tray B is the one to be copied next (YES in n145), it is transported onto the document table 63 by an operation in Mode 3 (n146). Corresponding to this transfer, n is decreased by 1 (n147) and the document is copied (n148) and thereafter transported onto Tray A by an operation in Mode 4 (n149). As explained above in connection with Steps n130, n131 and n132, the contents of memory areas A(i) are shifted (n150), m is increased by 1 (n151) and M(S) becomes stored in the memory area A(1) (n152). This routine is repeated until S becomes equal to $S_m$ (n153).

If the aforementioned document at the bottom on Tray B is not the one to be copied next (NO in n145), it is transported onto Tray A by operations in Modes 3 and 4 (n154) and, correspondingly, the contents of memory areas A(i) are shifted (n155), m is increased by 1 (n156), the content of memory areas B(n) becomes stored in A(1) (n157) and n is decreased by 1 (n158). This is repeated until all documents on Tray B are transported away (NO in n159). If n=0 in Step n159, this means that there are still documents left on Tray A and the program returns to Step n125.

If $S=S_m$ in Step n153, indicating that all documents to be copied have been copied, the documents on Tray B are sequentially transported onto Tray A (n161), m being increased by 1 (n162) and n being reduced by 1 (n163) each time until n becomes 0 (YES in n160), indicating that all documents have returned to Tray A and that the process has ended. If the condition $S=S_m$ is met in Step n133 while a document is being transported from Tray A onto Tray B, documents on Tray A continue to be transported onto Tray B (n141), each time m being reduced by 1 (n142) and n being increased by 1 (n143) until m becomes 0 (YES in n140). Then, the program proceeds to Step n160 to repeat Steps n161 through n163 until all documents on Tray B are sequentially transported onto Tray A. In this manner, all documents are stacked again on Tray A in the original sequence.

FIG. 14 shows the sequence according to the process described above by which five documents originally stacked on Tray A in order of pages 1–5 are copied in the order of pages 3, 5, 2 and 4, and returned to their original positions on Tray A in the original sequence. FIG. 14, being self-explanatory, shows for this example (where $d_m=5$ and $S_m=4$) that the first two pages from the bottom (5 and 4) are sequentially transported onto Tray B by operations in Modes 1 and 2 (Steps 1 and 2), that the third document (page 3), being the next document to be copied and at the bottom of the stack on Tray A, is transported to the document table by an operation in Mode 1 for copying (Step 3) and then discharged onto Tray B by an operation in Mode 2 (Step 4), and so forth. It further shows that the desired copying operations are finished by Step 15, that the documents on Tray A at this moment are thereafter sequentially transported onto Tray B (Steps 16–19) and that the documents thus stacked on Tray B are sequentially transported back onto Tray A (Steps 20–24).

In summary, with a copier equipped with an automatic document feeder according to the present invention as illustrated above, the user can set a plurality of documents on the supply table, specify which of these documents are to be copied and in what sequence they are to be copied, and have copies made in the specified sequence and the documents returned in the originally placed sequence. These operations are all done automatically and hence errors, which are prone to occur if the documents are handled manually, can be prevented and there is no need for an extra mechanism to retrieve the processed documents from the intermediate tray to the supply tray.

Figure 15:
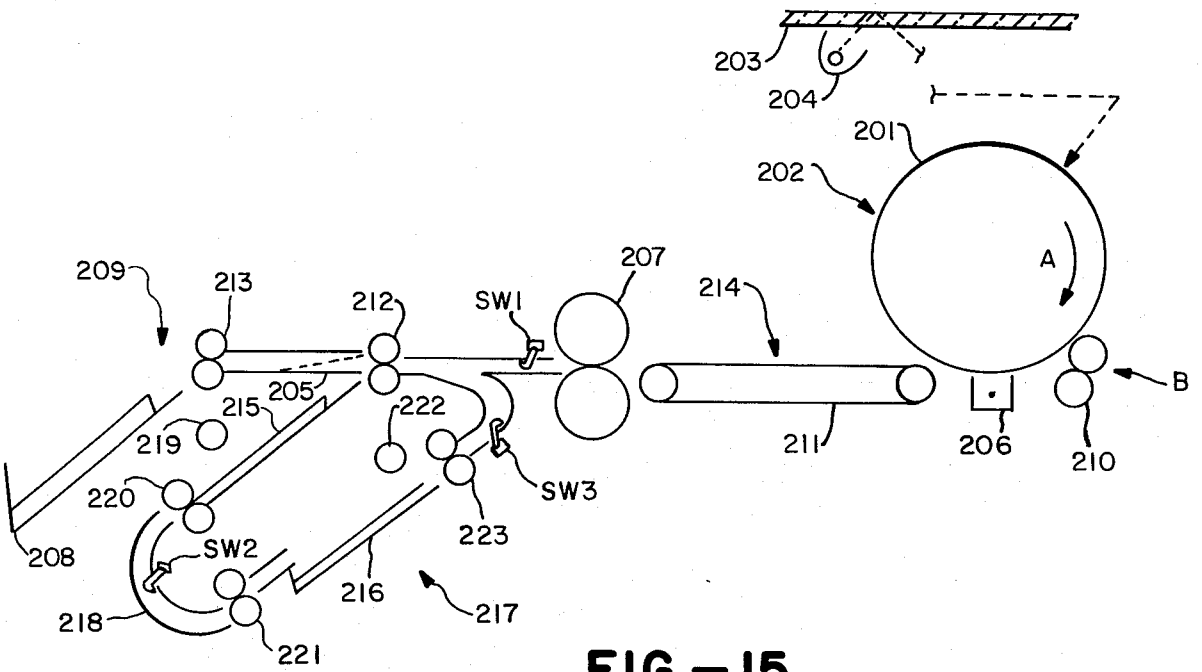
FIG. 15 is a schematic front view showing the structure of principal sections of a copier with paper discharging device embodying the present invention.

In still another aspect, the present invention relates to a copier from which copy paper sheets onto which images have been transferred can be discharged in a specified sequence which may be different from the order in which these sheets were processed. A copier of this type embodying the present invention, as shown in FIG. 15, is comprised of a processing section 202, a paper supply section (not shown), a paper discharge section 209 and a holding section 217. The processing section 202 includes a photoreceptor drum 201 supported rotatably in the direction of the arrow A as well as several devices disposed around its periphery. For copying, light from a copy lamp 204 is reflected by a document positioned on a document table 203 and made incident on the surface of the photoreceptor drum 201 as shown by a broken line to form thereon an electrostatic latent image. A developing agent is applied to this image by a developing device (not shown) and visible (toner) image is obtained.

In synchronism with the rotation of the photoreceptor drum 201 in the direction of the arrow A, copy paper is introduced one sheet at a time in the direction of the arrow B from the aforementioned paper supply section through feed rollers 210. The copy paper sheet is introduced between the photoreceptor drum 201 and a transfer charger 206 which serves by way of a corona discharge to transfer the toner image on the photoreceptor drum 201 onto the copy paper. The copy paper is thereafter transported through a paper transporting route 214 provided with a belt 211 to fixing rollers 207 which heat and compress the copy paper to melt and fix the image. The copy paper thus processed is transported into the discharge section 209 through discharge rollers 212 and 213.

The paper transporting route 214 is provided with a flapper 205 between the rollers 212 and 213. The flapper 205 is adapted to take one of two positions selectively. When it takes the position shown by a solid line, it serves to open the route 214 in the direction of the discharge section 209. The aforementioned holding section 217 is comprised of a first holding tray 215 and a second holding tray 216 and is disposed below the discharge rollers 212 of the paper transporting route 214. If the flapper 205 is made to assume the position shown by a broken line instead, it serves to open the paper route 214 to one (upper) end of the aforementioned first holding tray 215 of the holding section 217. The other (lower) end of the first holding tray 215 is connected to one (lower) end of the second holing tray 216 through a guide 218. The other (upper) end of the second holding tray 216 connects to the paper route 214 between the fixing rollers 207 and the discharge rollers 212 as shown. A pickup roller 219 and transporting rollers 220 are provided to the first holding tray 215. The guide 218 is provided with transporting rollers 221. A copy paper sheet on the first holding tray 215 is transported onto the second holding tray 216 by the operations of this pickup roller 219 and the transporting rollers 220 and 221. The second holding tray 216 is provided with another pickup roller 222 and transporting rollers 223 which operate together to transport a copy paper sheet held on the second holding tray 216 in the direction of the discharge rollers 212.

A paper detection switch SW1 is provided to the paper route 214 between the fixing rollers 207 and the discharge rollers 212. The holding section 217 is likewise provided with a similar paper detection switch SW2 in the guide 218 and another paper detection switch SW3 between the transporting rollers 223 and the paper transporting route 214. These detection switches SW1–SW3 serve to detect a copy paper sheet passing their respective positions.

Figure 16:
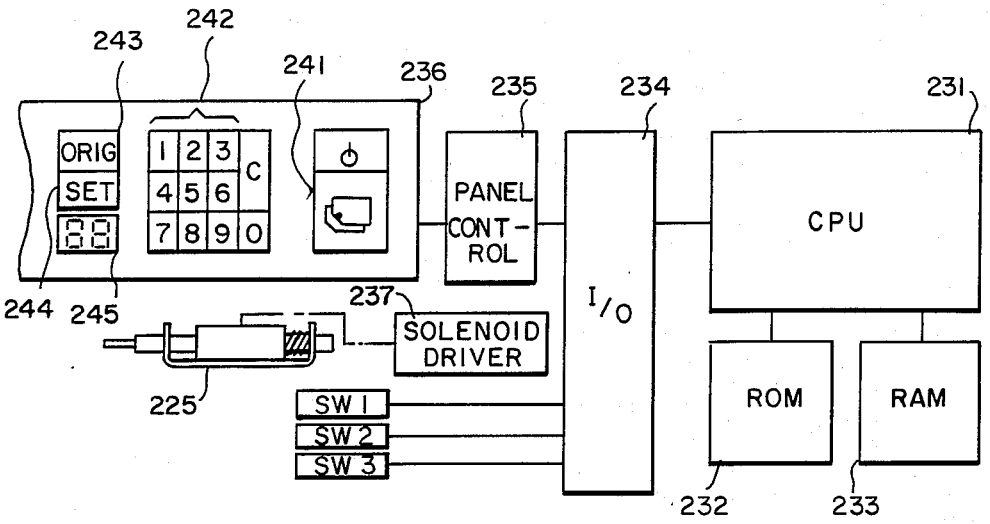
FIG. 16 is a block diagram of a control unit for the copier shown in FIG. 15, FIGS. 17(A) and 17(B) and 17(C) show a memory map of the RAM of FIG. 16.

With reference next to FIG. 16, the control unit for the copier described above by way of FIG. 15 includes a central processing unit CPU 231 to which various input data are transmitted through an interface (I/O) 234 from a panel control means 235 connected to the keys operated on a control panel 236. The control panel 236 is provided with a print switch 241, number keys 242, a document key 243 and a set key 244. A display device 245 may also be made a part of the panel 236. When the aforementioned keys are operated on the control panel 236, corresponding data are stored in various memory areas of RAM 233.

Detection signals from the paper detection switches SW1–SW3 are also received by the CPU 231 through the interface 234 and the CPU 231 transmits control data for various devices to a solenoid driver 237, etc. through the interface 234 in response to the keys which were operated according to a control program stored in ROM 232. The solenoid driver 237 serves to control the position of the flapper 205 through a solenoid 225 connected thereto.

Figure 17A:
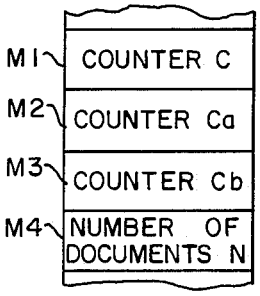
Figure 17B:
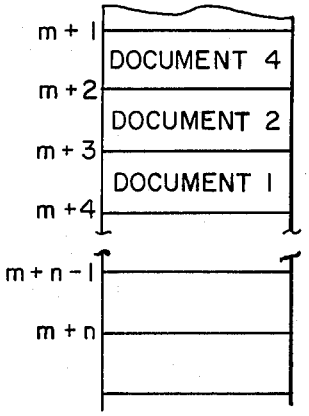
Figure 17C:
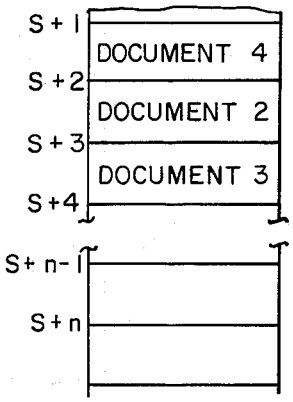

A memory map of the RAM 233 is illustrated in FIGS. 17(A), 17(B) and 17(C). FIG. 17(A) shows memory areas M1–M3 of the RAM 233 assigned to counters C, Ca and Cb to be explained below. FIG. 17(B) shows memory areas m+1 through m+n for storing input data received through operation of the document key 243 and the set key 244 and relating to the sequence in which discharged copy paper sheets are to be arranged. The counter C serves to specify an address corresponding to an area between m+1 and m+n. FIG. 17(C) shows areas S+1 through S+n for storing the sequence of discharged copy paper sheets in the first holding tray 215. The counter Cb specifies an address corresponding to an area between S+1 and S+n.

Figure 18A:
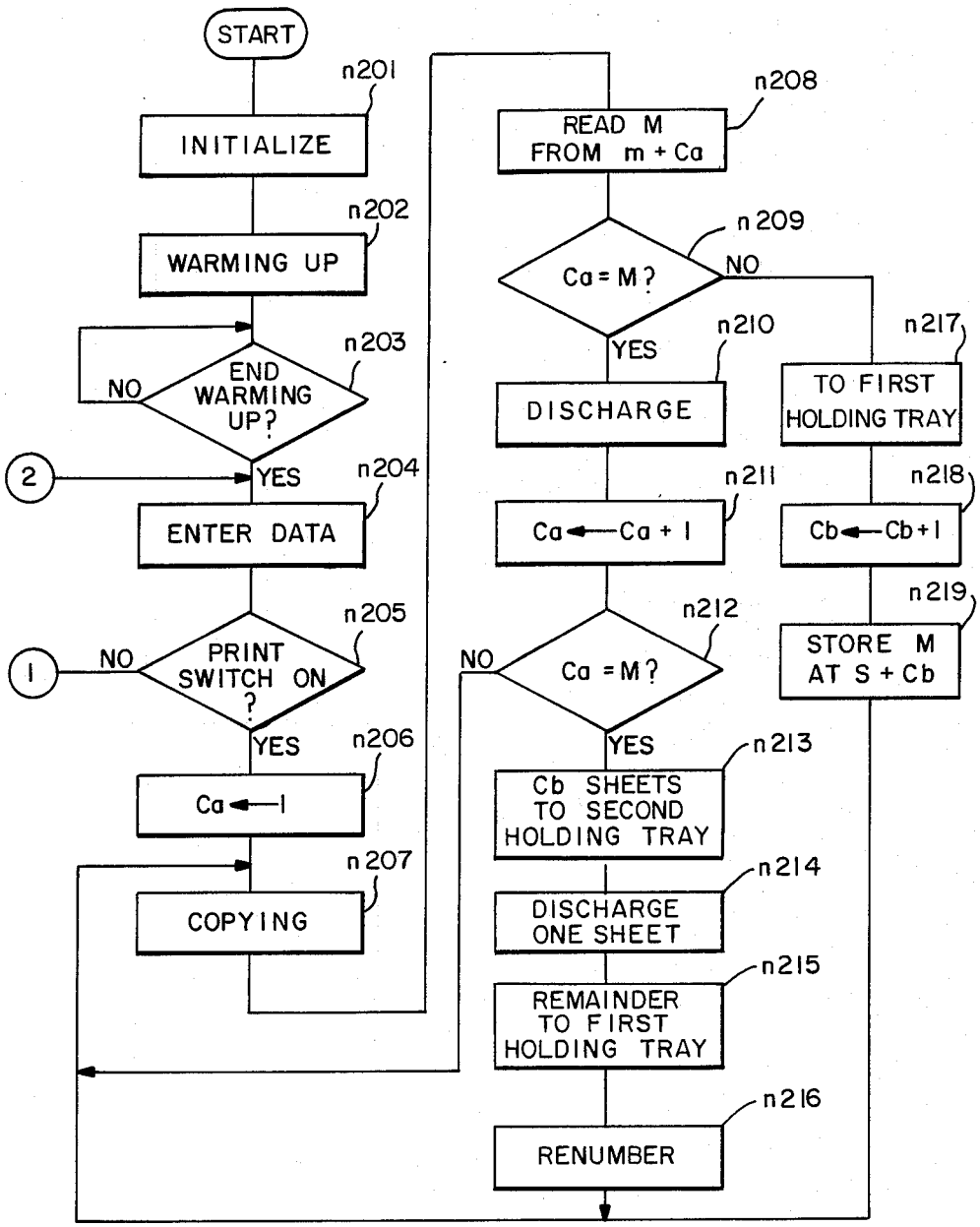
FIG. 18 is a flow chart of an operating program for the CPU of FIG. 16.
Figure 18B:
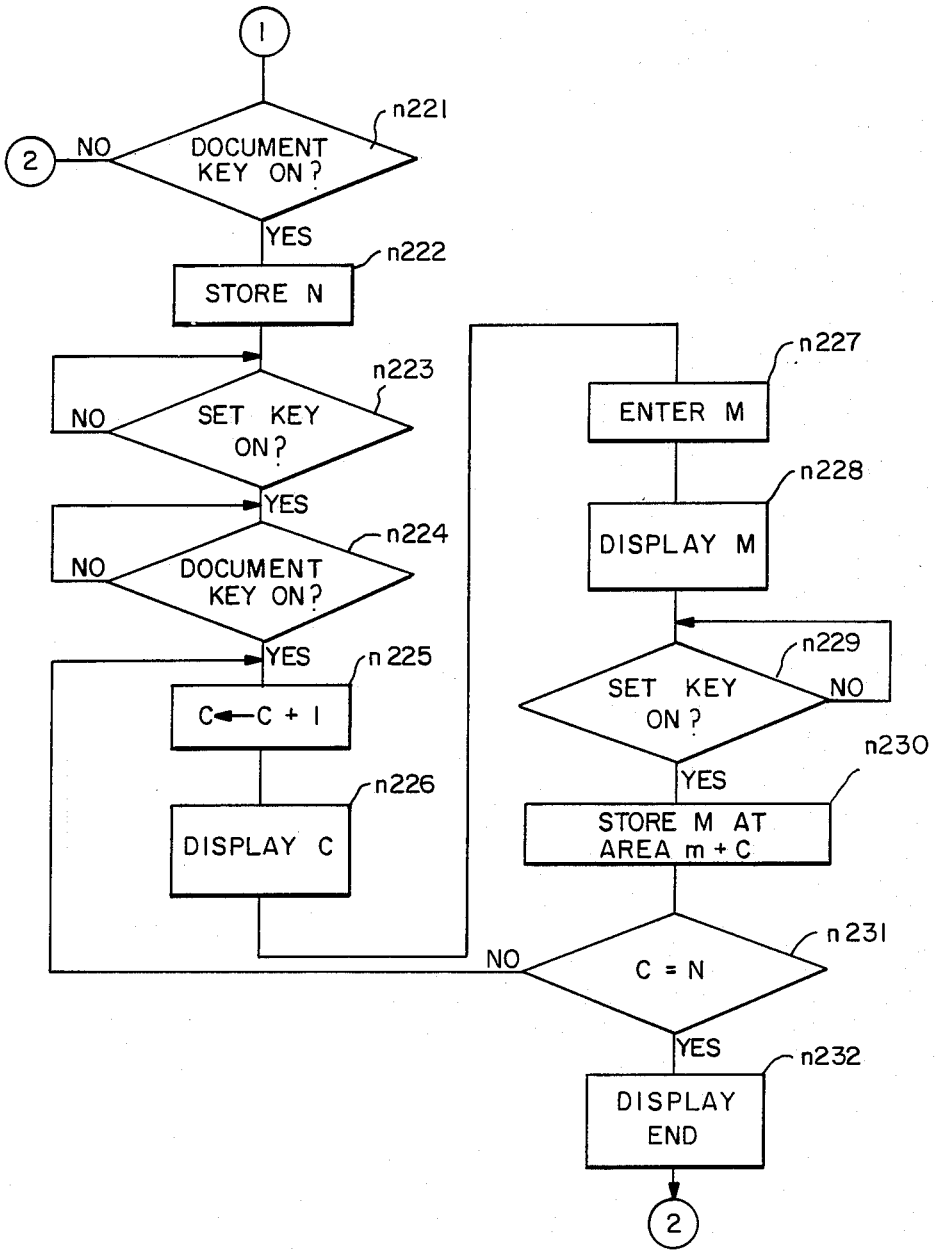

The control program for the operation of the CPU 231 is explained next by way of the flow chart of FIG. 18. When power is switched on, memory areas of the RAM 233 n+1 through n+n and S+1 through S+n are cleared and the counters C, Ca and Cb are reset (n201). The fixing rollers 207 are warmed up (n202) until the temperature reaches a predefined level (n203). Data indicative of conditions of copying operations are thereafter accepted from the control panel 236 (n204). While the program waits for the print switch 241 to be operated (NO in n205), it keeps monitoring whether the document key 243 has been operated (n221). If the print switch 241 is operated (YES in n205) but the document key 243 has not been operated, a regular printing routine is followed. If the document key 243 is operated while the program is waiting for the print switch 241 to be operated (YES in n221), the number of documents n entered thereafter through operations of the number keys 242 is stored in memory area M4 of the RAM 233 (n222). Thereafter, the program waits for the set 244 and the document key 243 to be operated (n223 and n224) and, if these keys are operated, the contents of the counter C is increased by 1 (n225) and its value is displayed in the display device 245 (n226). When a discharge sequence number M is received thereafter through the operation of a number key or keys 242 (n227), this number is displayed (n228) and the program waits for the set key 244 to be operated (n229). If the set key 244 is operated thereafter (YES in n229), the discharge sequence number M thus received is stored at the position of an address specified by the content of the counter C within the range of areas between m+1 and m+n (n230). The process from Step n225 to Step n230 is repeated until the content of the counter C reaches n (n231). When discharge sequence numbers M are assigned to all n documents (YES in n231), the display device 245 displays a predefined message signifying that the sequence assignment has been completed (n232) and the program returns to Step n204.

If the print switch 241 is operated after discharge sequence numbers M are entered (YES in n205), the counter Ca is set to (n206) and the copying process is carried out (n207). The purpose of the counter Ca is to indicate the discharge sequence of the next paper. Thus, the value of M is read from the address obtained by adding m to the content of the counter Ca (also indicated by Ca for convenience) (n208) and is compared with the content of the counter Ca (n209).

If the value of M stored at address m+Ca in the RAM 233 agrees with the content of the counter Ca (YES in n209), the solenoid 225 is switched off such that the flapper 205 assumes the position indicated by the solid line in FIG. 15. This causes the copy paper from the processing section 202 to pass through the paper transporting route 214 to be discharged onto a discharge tray 208 of the paper discharge section 209 (n201. If the sequence number M does not agree with Ca (NO in n209), the incoming copy paper is directed onto the first holding tray 215 by switching the solenoid 215 on so that the flapper 205 assumes the position indicated by the broken line in FIG. 15 (n217). Thereafter, the content of the counter Cb (also indicated by Cb for convenience) is increased by 1 (n218) and the value of M which was read in Step n208 is stored at the address S+Cb (n219). The program then proceeds to Step n207 and the next document is copied.

After an incoming copy paper sheet is directly discharged onto the discharge tray 208 in Step n210, the content of the counter Ca is increased by 1 (n211) and the program examines whether the discharge sequence number M corresponding to the updated content of the counter Ca is found at any address in the RAM 233 within the range S+1 and S+n (n212). If there is not (NO in n212), the next document is copied (n207). If there is (YES in n212), its address is read and the position on the first holding tray 215 of the copy paper sheet with the image corresponding to this sequence number is determined. If such sheet is at the (Cb)th position, Cb copy paper sheets are transported from the first holding tray 215 to the second holding tray 216 (n213). After this is done, only the top sheet on the second holding tray 216 is discharged onto the discharge tray 208 (n214) by placing the flapper 205 in the position shown by the solid line in FIG. 15. Thereafter, the solenoid 225 is switched on and the sheets remaining on the second holding tray 216 are transported back to the first holding tray 215 (n215). Now that one of the sheets on the first holding tray 215 has been removed by this series of operations (n214 through n215), the addresses in the RAM 233 in the range between S+1 and S+n are renumbered (n216). This is done by subtracting 1 from each address which is greater than the address corresponding to the sheet discharged in Step n214. Thereafter, the next document is copied (n207) and another copy paper sheet is transported from the processing section.

In summary, the user preliminarily operates the keys on the control panel 236 to store a desired sequence in which copies of documents should be received by the discharge tray 208. This sequence M is stored in memory areas in the range between m+1 and m+n. Each time a document is copied, a sequence corresponding to the copy is read from the memory and it is compared with the content of the counter Ca which indicates the next sequence number. If they agree, the copy paper is directly discharged onto the discharge tray 208. If they do not agree, however, it is rerouted to the first holding tray 215. The discharge sequence M of the copy paper sheets is stored in the memory areas in the range between S+1 and S+n. Whenever the content of the counter Ca is updated, the contents of the memory areas S+1 through S+n are searched to check whether the sequence number in agreement with the content of the counter Ca is present or not. This is to check whether or not the copy paper sheet which is to be discharged next according to the initially stored sequence data is currently on the first holding tray 215. If it is, the sheets stacked on the first holding tray 215 are sequentially transferred to the second holding tray 216 until the sheet to be discharged next is transported to the second holding tray 216. Then, this sheet is discharged and the remaining sheets which have been transported to the second holding tray 216 are returned to the first holding tray 215. By this process, documents are copied sequentially as they are stacked but the copies thereof can be discharged in any sequence according to the input made by operating keys on the control panel.

The foregoing description of the invention has been presented for the purpose of illustration. These examples are by no means intended to limit the scope of the present invention and obviously many modifications and variations are possible in light of the disclosures made herein. With reference to the disclosure made above by way of FIG. 2, for example, two separate flappers may be provided to selectively guide documents from the document table 4 and the second intermediate tray 53. With reference to the disclosure by way of FIG. 10, as another example, the intermediate tray 62 may be dispensed with because documents can be recirculated between the document table 63 and the supply table 61 to obtain the same result in the specified sequence. Such modifications and variations that may be apparent to persons skilled in the art are intended to be included within the scope of this invention.

What is claimed is:

1. A document transporting device comprising
document discharging means for discharging documents sequentially,
a discharge tray,
intermediate tray means including a first intermediate tray and a second intermediate tray,
selective document transporting means for transporting documents selectively from said document discharge means to said discharge tray or to said intermediate tray means and from said intermediate tray means to said discharge tray, said selective document transporting means being adapted to selectively transport a document through said document discharging means to said first intermediate tray or to said discharge tray, from said first intermediate tray to said second intermediate tray, from said second intermediate tray to said first intermediate tray or to said discharge tray,
discharge sequence memory means for storing data indicative of a sequence in which documents are to be discharged onto said discharge tray, and
control means for controlling the operation of said selective document transporting means according to a sequence stored in discharge sequence memory means.

2. The device of claim 1 wherein said selective document transporting means includes a flapper which can assume two positions and direct a document moving from said document discharging means or said second intermediate tray selectively to said first intermediate tray or to said discharge tray.

3. In a copier having a paper supply section, a processing section, a discharge section, and a paper transportation route through which a copy paper sheet is transported from said paper supply section through said processing section to said discharge section, said processing section being adapted to copy a plural N-number of documents in a predetermined sequence and to eject processed copy paper sheets in said predetermined sequence,
the improvement wherein said copier comprises
input means for specifying a discharge sequence in which copy sheets processed in said predetermined sequence in said processing section are to be discharged into said discharge section,
a holding section for selectively holding processed copy paper sheets temporarily, said holding section including a first holding tray adapted to receive copy paper sheets from said paper transporting route and a second holding tray connected to said first holding tray and to said paper transporting route, a counter means for indicating an n-number indicative of the number of processed copy paper sheets which have been discharged into said discharge section, and control means for causing the mth processed copy paper sheet in said specified discharge sequence, m being a dummy integer between I and N inclusive, to be transported from said processing section selectably to said discharge section without passing through said holding section or to said holding section, depending on a relationship between m and said n-number, said control means serving to cause copy paper sheets to be selectively transported from said first holding tray to said second holding tray or from said second holding tray to said discharge section.

* * * * *

UNITED STATES PATENT AND TRADEMARK OFFICE

CERTIFICATE OF CORRECTION

PATENT NO. : 4,855,788

DATED : August 8, 1989

INVENTOR(S) : Fujii

It is certified that error appears in the above-identified patent and that said Letters Patent is hereby corrected as shown below:

Col. 15, line 9, "I" should read --l--.

Signed and Sealed this

Seventeenth Day of July, 1990

*Attest:*

HARRY F. MANBECK, JR.

*Attesting Officer*

*Commissioner of Patents and Trademarks*